US011798771B2

(12) United States Patent
Lee et al.

(10) Patent No.: US 11,798,771 B2
(45) Date of Patent: Oct. 24, 2023

(54) ADJUSTABLE FREQUENCY TUBE RESONATORS

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US); Ryohei Tsuruta, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 239 days.

(21) Appl. No.: 17/163,705

(22) Filed: Feb. 1, 2021

(65) Prior Publication Data

US 2022/0246382 A1 Aug. 4, 2022

(51) Int. Cl.

| | |
|---|---|
| ***G10K 11/172*** | (2006.01) |
| ***H01J 23/18*** | (2006.01) |
| ***H01J 25/58*** | (2006.01) |

(52) U.S. Cl.

CPC ..... *H01J 23/18* (2013.01); *G10K 11/172* (2013.01); *H01J 25/58* (2013.01)

(58) Field of Classification Search

CPC ... G10K 11/172; F01N 1/161; F01N 2490/16; F01N 1/006; F01N 1/02; F01N 1/023; F01N 1/16; F02M 35/1222; F02M 35/1255

USPC ..... 181/197

See application file for complete search history.

(56) References Cited

U.S. PATENT DOCUMENTS

| | | | | |
|---|---|---|---|---|
| 6,508,331 | B1 * | 1/2003 | Stuart | F02M 35/1266 123/184.57 |
| 9,186,666 | B2 * | 11/2015 | Hofstetter | G01F 25/14 |
| 9,308,326 | B2 | 4/2016 | Hunter et al. | |
| 10,088,165 | B2 | 10/2018 | Nguyen et al. | |
| 2004/0212464 | A1 * | 10/2004 | Rawnick | H01P 7/065 333/231 |

OTHER PUBLICATIONS

Machine Translation of Transducer of Drill Bit Rotation Speed in Turbodrilling (SU-1696664-A1). Inventor: Savinykh Yu A. Published: Dec. 7, 1991 (Year: 1991).*

Zhu, Y. et al., "Broadband ultra-thin acoustic metasurface absorber", Applied Physics Express, vol. 12, No. 11 (2019) 12 pages.

Yang et al., "Optimal sound-absorbing structures," Material Horizon, Issue 4 (2016) 22 pages.

(Continued)

*Primary Examiner* — Shawki S Ismail

*Assistant Examiner* — Jennifer B. Olson

(74) *Attorney, Agent, or Firm* — Christopher G. Darrow; Darrow Mustafa PC

(57) ABSTRACT

Frequency adjustable quarter-wavelength resonators have a movable end wall defined by a surface of a sphere that is moved within the resonator tube. The sphere can be ferromagnetic, enabling it to be moved by magnetic interactions with moving external magnetic elements, or by a variable external magnetic field, controlled by power modulation to external electromagnets. The resonators can optionally be helical or otherwise curved, and the spherical shape of the structure forming the end wall enables it to navigate curves in the resonator tube.

20 Claims, 9 Drawing Sheets

(56) References Cited

OTHER PUBLICATIONS

Jimenez, N. et al., "Rainbow-trapping absorbers: Broadband, perfect and asymmetric sound absorption by subwavelength panels for transmission problems," Scientific Reports 7:13595 (2017) pp. 1-12.

* cited by examiner

FIG. 1A
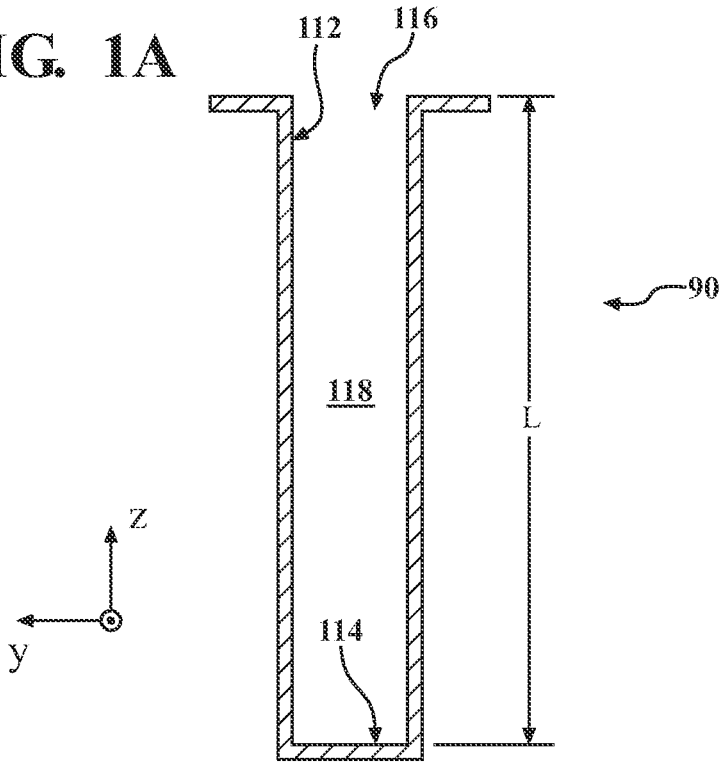
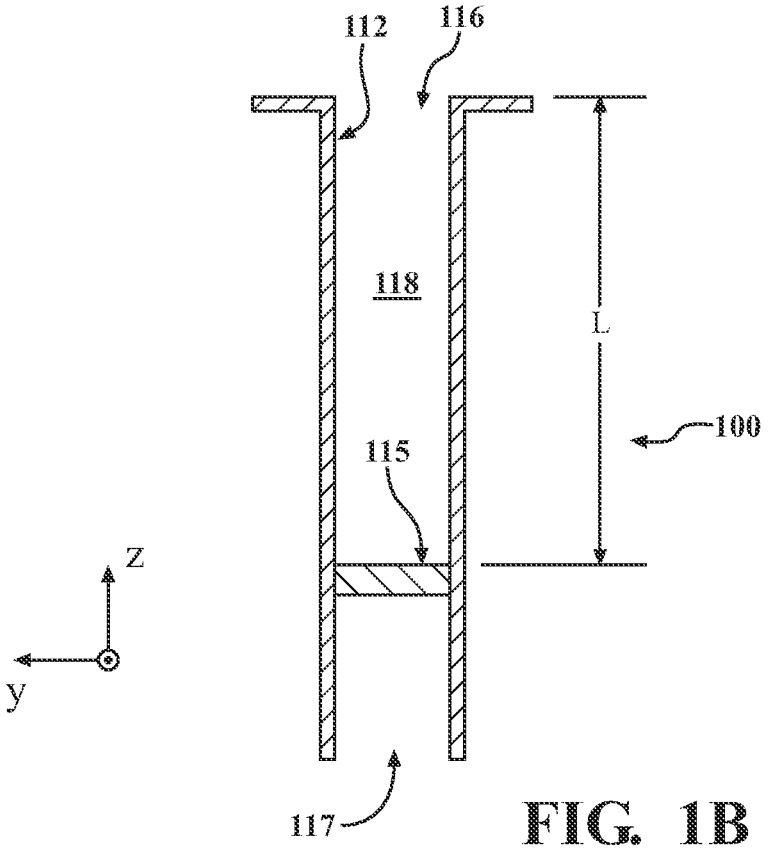
FIG. 1B

FIG. 2A
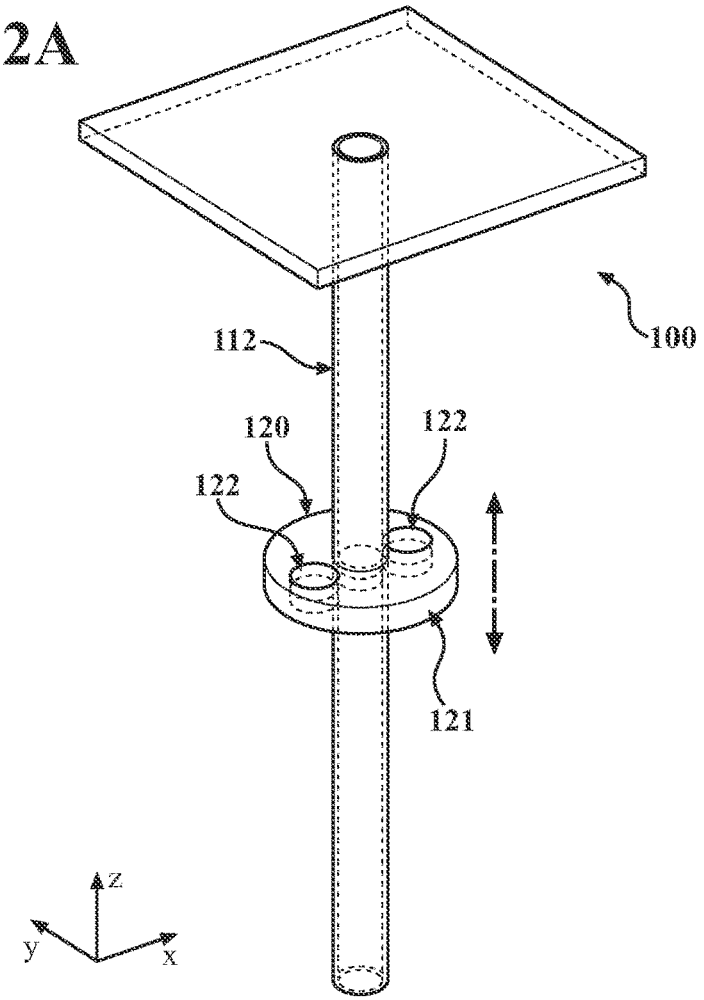
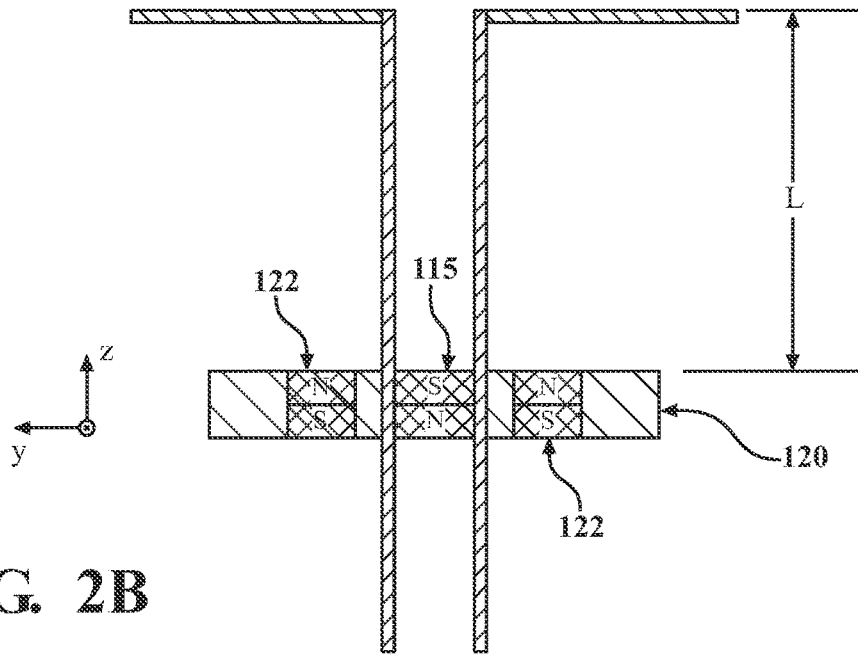
FIG. 2B

FIG. 4A
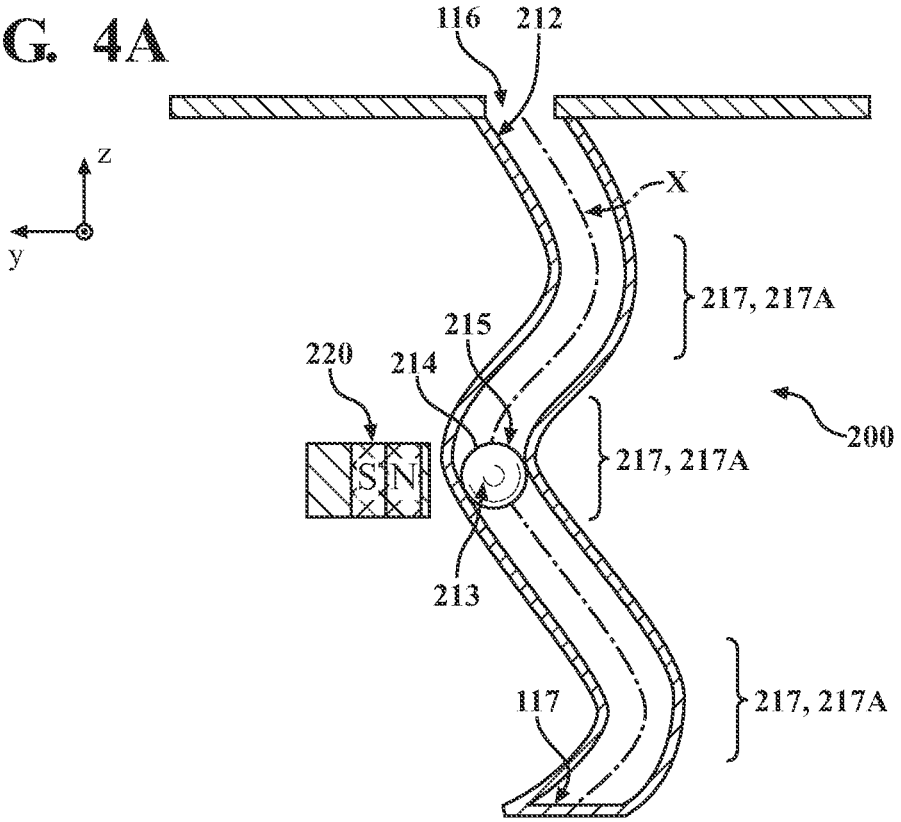
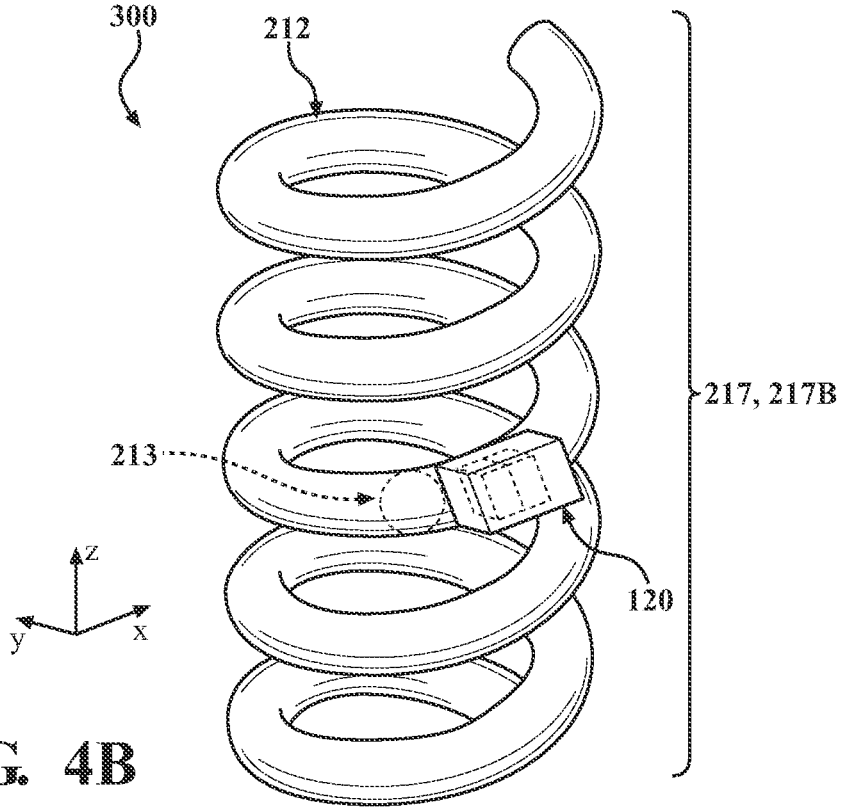
FIG. 4B

FIG. 4C
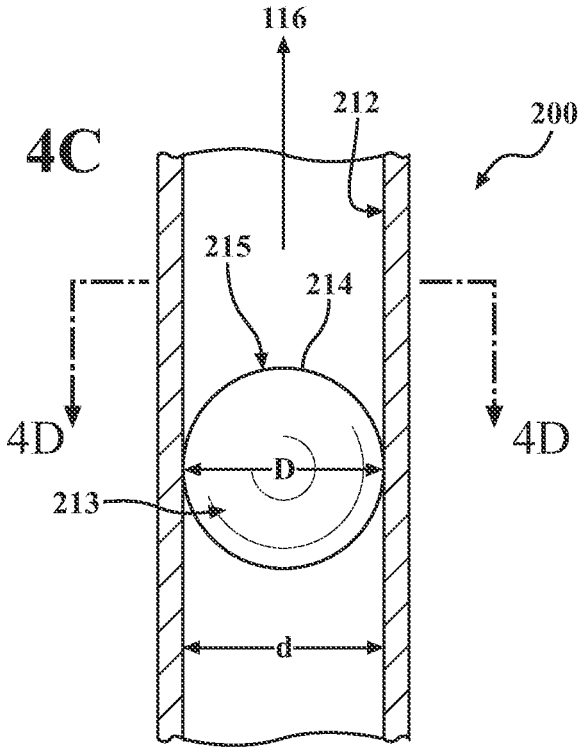
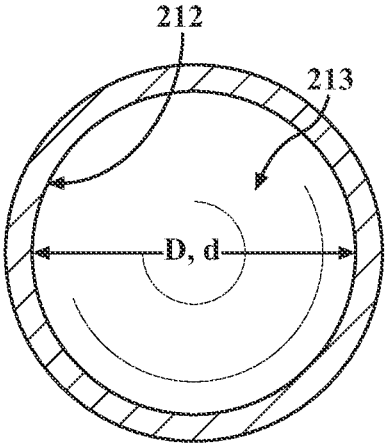
FIG. 4D
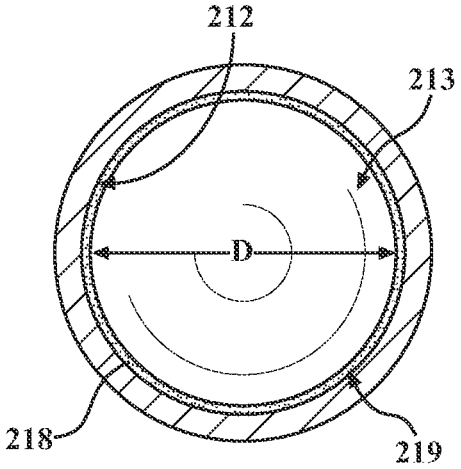
FIG. 4E

FIG. 5
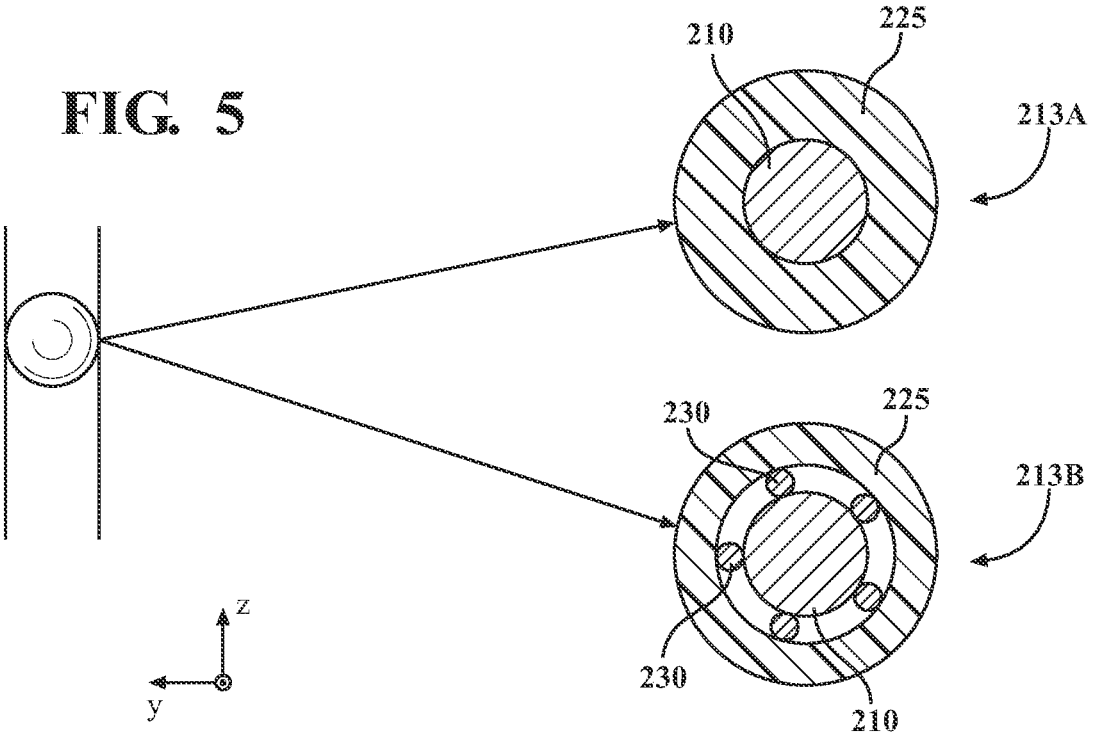
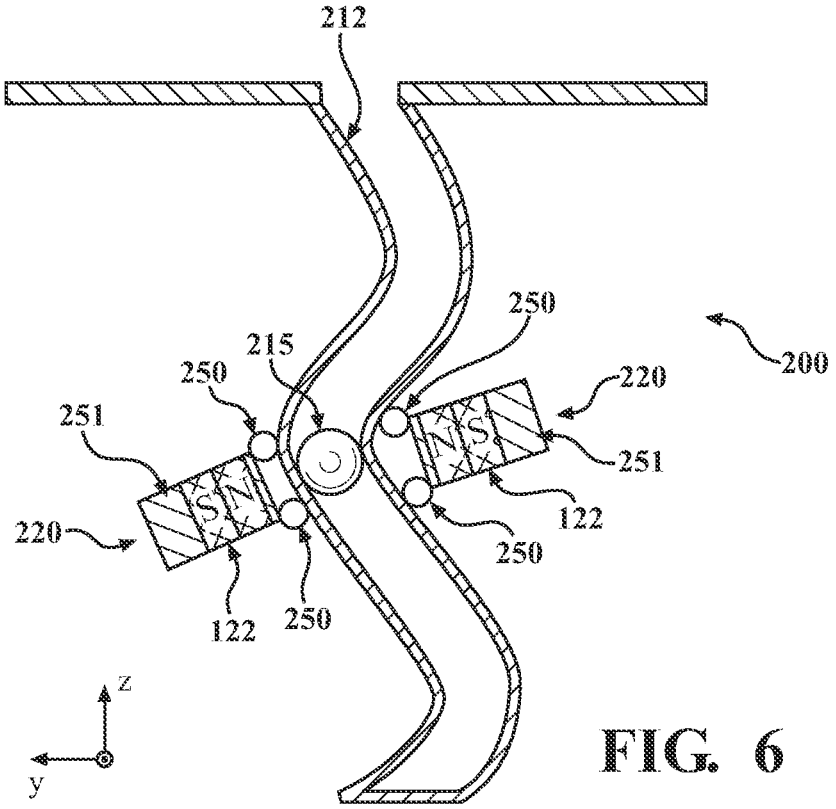
FIG. 6

ADJUSTABLE FREQUENCY TUBE RESONATORS

TECHNICAL FIELD

The present disclosure generally relates to resonant sound absorbers and, more particularly, to quarter wavelength acoustic resonators having adjustable resonance frequency.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Quarter-wave, or tube, resonators can be used in a wide variety of applications for frequency specific sound absorption. These resonators generally have a tubular structure with an open and an opposite end wall, with a specified length between (the tube length). They resonantly absorb sound having wavelength that is four times the length of the tube. This is because sound of the resonant wavelength/frequency traverses half a wavelength when it enters the tube, reflects from the end wall, and emerges; the emerging sound wave is thus in destructive antiphase to incident sound of the same frequency.

In addition to variations in tube length/resonant frequency, quarter-wave resonators can have bends or other non-linear configurations. This can be useful in applications where space is limited. Furthermore, frequency of an individual resonator can be adjusted if a movable end wall is employed, rendering the effective length of the resonator variable. However, mechanisms for moving such movable end walls are lacking and, in particular, can be difficult to obtain for quarter-wave resonators that are curved.

Accordingly, it would be desirable to provide movable end walls for frequency-adjustable quarter-wave resonators, mechanisms for controlling end wall movement and, particularly, to provide the above for quarter-wave resonators that are coiled or otherwise curved.

SUMMARY

This section provides a general summary of the disclosure, and is not a comprehensive disclosure of its full scope or all of its features.

In various aspects, the present teachings provide a variable-frequency, curved tube acoustic resonator. The resonator includes a side wall forming a tube that defines a cylindrical resonance chamber. The tube has an open end configured to receive an incident acoustic wave, and a distal end opposite the open end. The tube further defines a curvilinear axis extending along the middle of the resonance chamber from the open end to the distal end. The curvilinear axis has at least one curved region. The resonator further includes a sphere positioned within the tube, defining an end wall. The sphere is movable along the curvilinear axis to vary a resonance frequency of the resonator.

In other aspects, the present teachings provide a variable-frequency, tube acoustic resonator. The resonator includes a side wall forming a tube that defines a cylindrical resonance chamber. The tube has an open end configured to receive an incident acoustic wave, and a distal end opposite the open end. The resonator further includes a sphere, defining an end wall. The sphere is at least partially formed of a ferromagnetic material, is positioned within the tube, and is movable along a longitudinal tube axis to vary a resonance frequency of the resonator. The resonator further includes a first electromagnet positioned adjacent to the open end, and a second electromagnet positioned adjacent to the distal end. Power modulation to the first and second electromagnets enables a variable magnetic field to impel the sphere along the longitudinal axis.

In still other aspects, the present teachings provide a variable-frequency, curved tube acoustic resonator. The resonator includes a side wall forming a tube that defines a cylindrical resonance chamber. the tube has an open end configured to receive an incident acoustic wave, and a distal end opposite the open end. The tube defines a curvilinear axis extending along the middle of the resonance chamber from the open end to the distal end, and the curvilinear axis has a helical shape. The resonator further includes a sphere positioned within the tube, and defining an end wall. The sphere is movable along the curvilinear axis to vary a resonance frequency of the resonator.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein:

FIG. 1A is a schematic side cross-sectional view of a conventional quarter-wavelength acoustic resonator;

FIG. 1B is a schematic side cross-sectional view of a straight-tube quarter-wavelength resonator of the present teachings, having a movable end wall conferring variable resonance frequency;

FIGS. 2A and 2B are a partially transparent perspective view and a cross sectional view, respectively, of a variable frequency quarter-wavelength resonator having a ferromagnetic movable end wall and an external magnetic element enabling movement of the end wall;

FIG. 4A is a cross-sectional view of a curved quarter-wavelength resonator, having a spherical end wall and a generic external magnetic element;

FIG. 4B is a partially transparent helical quarter-wavelength resonator having a spherical end wall and a generic external magnetic element;

FIG. 4C is a magnified cross-sectional view of a linear portion of a resonator of the type shown in FIG. 4A, emphasizing details of a sphere defining the end wall;

FIG. 4D is an alternative cross-sectional view of the portion shown in FIG. 4C, and viewed along the line 4D-4D of FIG. 4C;

FIG. 4E is a view of the type shown in FIG. 4D, illustrating a variation in which the sphere diameter is less than the inner diameter of the resonator tube;

FIG. 5 provides three cross sectional views showing different variations of spherical magnetic element;

FIG. 6 is a cross sectional view of the curved resonator of FIG. 4A, with a wheeled mechanism for moving an external magnetic element along the resonator side wall;

Figure 2C:
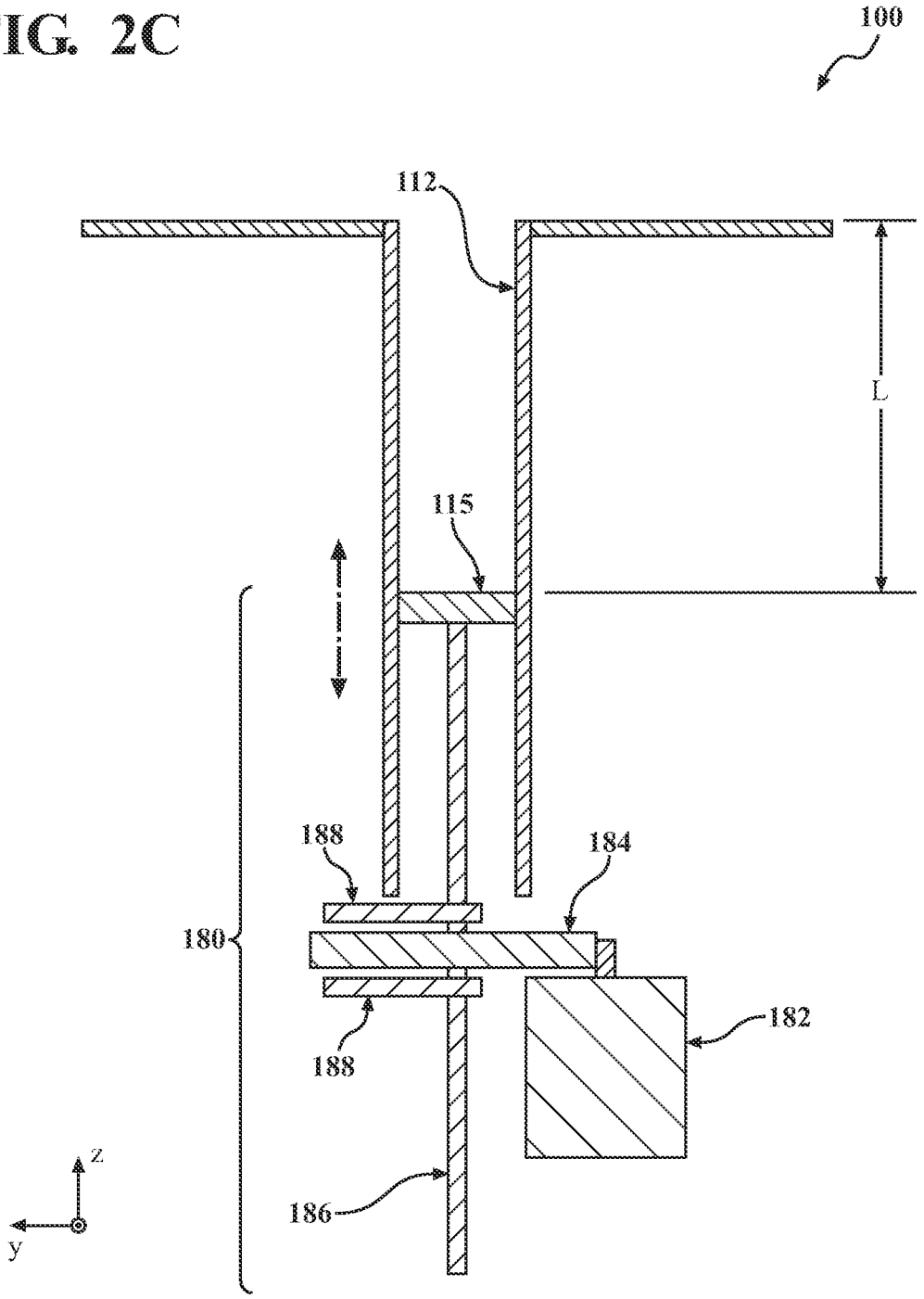
FIG. 2C is a cross sectional view of a variable frequency quarter-wavelength resonator having a motorized mechanism for movement of the end wall.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present teachings provide variable frequency quarter-wave resonators. Movable end walls within the resonators adjust effective length and thereby modulate resonance frequency. As such, a disclosed resonator can be easily adjusted to absorb a variety of different pitches.

The disclosed resonators in different variations can be helical, or otherwise curved, to accommodate tight spaces. Ferromagnetic spheres defining end walls are utilized in conjunction with external magnetic elements to impel the spherical end walls within the curved resonator. Various systems and mechanisms are disclosed for achieving these ends.

FIG. 1A shows a side cross sectional view of a conventional tube resonator 90. The tube resonator 90 has at least one side wall 112, an end wall 114, and an open end 116, thereby defining and open-ended resonance chamber 118. The open-ended resonance chamber 118 has a length, L, defined as the distance from the open end 116 to the end wall 114. It will be understood that the tube resonator 90 has a resonance frequency, $f_0$, described by Equation 1:

$$f_0 = \frac{c}{4L}, \qquad \text{Eq. 1}$$

where L is as defined above, and c is the speed of sound in the ambient medium.

FIG. 1B shows a cross sectional view of an adjustable frequency quarter-wavelength resonator of the present teachings. The adjustable resonator 100 as shown in FIG. 1B includes the at least one side wall 112, but instead of having a length defined by a static end wall 114, includes a movable end wall 115. The movable end wall is displaceable along a longitudinal direction of the resonator 100 (i.e. in the z-dimension of FIG. 1B). Thus, with reference to Equation 1, above, it will be understood that such displacement of the movable end wall 115 alters the length, L, of the resonator 100, and thereby adjusts the resonance frequency, $f_0$.

It will be noted that the distal end 117 of the resonator 100 (i.e. the end opposite the open end 116) can optionally be open, closed, or partially open (e.g. closed with a perforated wall). As such, the term "open end 116", as used herein, refers to the end of the resonator 100 that must be open, and upon which a target sound wave is incident.

FIGS. 2A and 2B show a partially transparent perspective view and a cross sectional view, respectively, of a variation of the adjustable resonator 100 of FIG. 1B. In the variation of FIGS. 2A and 2B, the end wall 115 may be ferromagnetic (i.e. formed partly or entirely of a ferromagnetic material such as iron, or a permanent magnet), and the resonator 105 further includes an external magnetic element 120 for displacing the movable end wall 115. The exemplary external magnetic element 120 of FIGS. 2A and 2B is shown as a sleeve 121, or housing component, encircling the exterior of the resonator side wall 112, and having at least a pair of external magnets 122 located therein. It will be understood that magnetic interaction between the external magnets 122 and the end wall 115 results in a scenario in which z-displacement of the external magnetic element 120 results in a concomitant movement of the end wall 115. Thus, the external magnetic element 120 can be moved manually or by mechanical means, thereby resulting in longitudinal movement of the end wall 115, modulation of the resonator length L, and modulation of the resonance frequency. In general, an external magnetic element can be configured to move along a longitudinal axis of the resonator 100.

FIG. 2C shows a side sectional view of another variation of the adjustable resonator 100 of FIG. 1B. In the variation of FIG. 2C, a motorized mechanism 180 drives z-displacement of the adjustable end wall 115. The exemplary motorized mechanism 180 of FIG. 2C includes a motor 182 in mechanical communication (via gear 184) with screw drive 186. A pair of z-displacement blockers 188 maintain the position of gear 184, such that actuation of the motor 182 moves the adjustable end wall 115 longitudinally within the resonator 100. As above, this adjusts the length and therefore the resonance frequency of the resonator 100. It will be understood that the variations of FIGS. 2A-2B and 2C can be combined; for example a motorized mechanism 180 can be placed in mechanical contact with the external magnetic element 120 of FIGS. 2A and 2B. More generally, any means for causing z-displacement of the adjustable end wall 114 can be acceptable.

Figure 3:
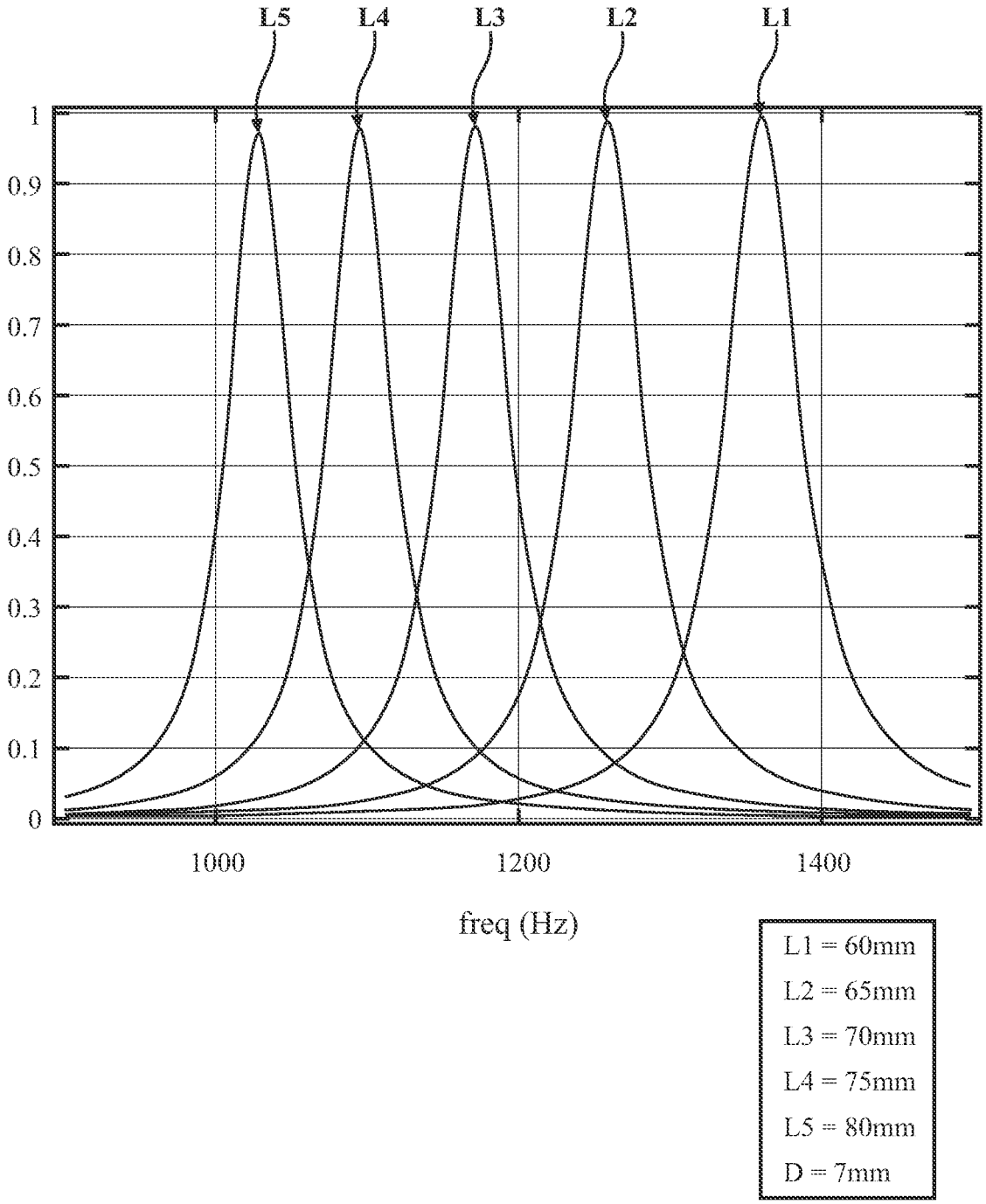
FIG. 3 is a plot of simulated absorption data for a resonator of any of the types in FIGS. 1B and 2A-2C, in which the end wall is in five different positions yielding five different effective resonator lengths.

FIG. 3 shows simulated acoustic absorption data for an adjustable absorber of FIG. 1B, with the length, L, adjusted to five different values. The results show a unique acoustic absorption maximum for each adjusted length and confirm the prediction, from Equation 1, above, that adjustment of the length via z-displacement of the adjustable end wall 14 enabled modulation of the resonance frequency.

It will be appreciated that, in some implementations, it will be desirable for an adjustable quarter-wavelength resonator 100 of the present teachings to have a compact shape, for deployments in which space is limited. In particular, implementations in which the desired length of the resonator 100 exceeds the corresponding dimension of the available space can benefit from an altered, non-linear shape of the resonator. In some variations, an adjustable resonator 100 of the present teachings can have a coiled or otherwise curved shape, to accommodate such scenarios.

FIG. 4A shows a cross sectional view of an exemplary curved channel resonator 200 having a side wall 212 characterized by three curvatures. FIG. 4B shows a partially transparent perspective view of an exemplary curved channel resonator 300 in which the side wall 112 is coiled, or helical. FIG. 4C shows a magnified cross-sectional view of a linear portion of a resonator 200 of the type shown in FIG.

4A. Referring to FIGS. 4A-4C, both resonators 200, 300 of FIGS. 4A and 4B utilize a sphere 213, defining a sphere surface portion 214 that operates as an adjustable end wall 215.

Referring particularly to FIG. 4C, the sphere 213 can have a diameter, D, and the side wall 212 can define an inner diameter, d, of the resonator 200, 300. The diameter, D, of the sphere 213 can be equal to or slightly less than the inner diameter, d, of the resonator 200, 300. In some implementations, the diameter, D, of the sphere 213 can be within a range of from about 0.95 d to about 1.0 d. The sphere surface portion 214 is that part of the surface of the sphere 213 that is in fluid communication (via air or other fluid acoustic medium) with the open end 116 of the resonator 200, 300. It will be understood that the sphere 213 can turn or roll as it moves within the interior of the resonator 200, 300 and that the portion of the sphere 213 that constitutes the sphere surface portion 214 defining the end wall 215 can be different at different times.

Referring again to FIG. 4A, the curved resonator defines a curvilinear longitudinal axis, X, extending longitudinally (i.e. from the open end 116 to the distal end 117). The curvilinear longitudinal axis can, for brevity, be referred to alternatively as a curvilinear axis. The resonator 200 has one or more curved regions 217, where the curvilinear longitudinal axis, X, locally deviates from linearity. In some implementations, a curved region 217 can be a planar curved region 217A, in which the deviation from linearity occurs in two dimensions only. In the example of FIG. 4A, each curved region 217 is a planar curved region with deviation from linearity in the y-z plane of FIG. 4A, and no deviation from linearity in the x-dimension. In some implementations, a curved region 217 can be a three-dimensional curved region 217B, where deviation from linearity occurs in all three x-y-z dimensions, such as a spiral or helical curve. While the curvilinear longitudinal axis, X, is omitted from FIG. 4B for visual clarity, it will be understood that the resonator 300 of FIG. 4B possesses a continuous three-dimensional curved region 217B across its entire length. In general a curved resonator 200, 300 can possess any combination of planar and three-dimensional curved regions 217 as best suited to accommodate the available space.

It will be appreciated that the adjustable end wall 115 of the type utilized in the adjustable resonator 100 of FIGS. 1A-1C can be difficult to incorporate into curved resonators 200, 300 of the types shown in FIGS. 4A and 4B, as it can tend to become stuck when encountering a curved region 217. As such, an end wall 215 defined by a sphere 213 can be utilized to introduce length adjustability into a curved channel resonator 200. The sphere 213 can be ferromagnetic, as discussed further below, and the curved resonators 200, 300 of FIGS. 4A and 4B can also include an external magnetic element 220 to direct passage of the end wall 215 through the resonator 200, 300.

FIG. 4D shows an alternative cross-sectional view of the resonator 200 portion of FIG. 4C, viewed along the line 4D-4D. FIG. 4E shows a cross-sectional view of the type shown in FIG. 4D, but where the sphere diameter, D, is less than the resonator 200 inner diameter, d. In the view of FIG. 4E, this difference (D minus d) is exaggerated relative to many or most implementations, in order to provide greater visual clarity. As shown in the example of FIG. 4E, a lubricating layer 218 can be employed to coat the side wall 212, to reduce friction as the sphere 213 moves within the resonator 200. In the example of FIG. 4E, where d>D, a gap 219 is present between the sphere 213 and the side wall 212. While this gap 219 is shown as being uniform, the sphere 213 can shift laterally so that, at any moment, the gap 219 is wider on one side than on the opposite side. It will be understood that such a gap 219 may allow acoustic leakage, wherein a fraction of an incident acoustic wave propagates through the gap 219, rather than reflecting from the end wall 215. In such instances, the lubricating layer 218 can further operate to fill the gap 219 and minimize acoustic leakage.

The sphere 213, can be formed in part or entirely of a ferromagnetic material. In some instances, the ferromagnetic material can be a material having soft magnetism, such as iron or a ferric alloy. In other instances, the ferromagnetic material can be a material possessing hard magnetism, such as a permanent magnet. FIG. 5 shows a side cross sectional view of a portion of a side wall 212 with a sphere 213, with a magnified view of two variations of sphere 213 having a ferromagnetic core with a non-magnetic coating 225 to facilitate movement within the resonator 200, 300. In one variation, the sphere 213A has a ferromagnetic core 210 surrounded by, and in direct contact with, a non-magnetic coating 225. This variation can be impelled to slide within the resonator 200 in response to a movement stimulus. In another variation, the sphere 213B can have a plurality of ball bearings 230 disposed between the ferromagnetic core 210 and the non-magnetic coating 225, enabling the non-magnetic coating 225 to turn or roll as the sphere 213 moves within the resonator 200, 300. It will be understood that when the sphere 213 is a multilayered structure such as in the examples of FIG. 5, the sphere diameter, D, is the outer diameter of the outermost layer (e.g. the non-magnetic coating 225).

In some variations comparable to sphere 213B, the sphere 213 can have a ferromagnetic core surrounded by a non-magnetic coating, with a layer of lubricant in between. In various non-limiting examples, such a lubricant can be a fluid, such as an oil, or a powder, such as polytetraethylene or graphite powder. In implementations of end wall forming spheres 213 of the types shown in FIG. 5, the ferromagnetic core 210 and non-magnetic coating 225 can be said to be rotationally independent of one another.

FIG. 6 shows a cross sectional view of one implementation for moving a sphere 213, defining an end wall 215 within a curved resonator 200, having two rolling external magnetic elements 220 positioned to impel movement of the sphere 213 within a curved resonator 200. In the example of FIG. 6, the curved channel resonator 200 is bounded by two rolling external magnetic elements 220, each having a permanent magnet 122. Each rolling external magnetic element 220 includes two or more bearing members 250 positioned to roll along an outer surface of the side wall 212. The two or more bearing members 250 can be actuated by a motor or other actuator 251 configured to assist rotation of the bearing members 250 so that the rolling external magnetic elements 220 move longitudinally along the side wall 212 (i.e. along the curvilinear extent of the side wall 212 between the open end 116 and the distal end 117. It will be understood that magnetic attraction between the magnet(s) 122 and the sphere 213 maintains the rolling external magnetic element 220 in contact with the side wall 212, and that longitudinal movement of the rolling external magnetic element 220 results in a corresponding longitudinal movement of the sphere 213.

The actuator 251 can be connected to a power supply (not shown) configured to supply power to the actuator. For example, the actuator can have a wired connection to an external power supply, or can be connected to a secondary battery located onboard the external magnetic element 220. In some implementations of the latter deployment, an inductive charger can be positioned adjacent to the path traversed by the external magnetic element, so as to periodically recharge the secondary battery.

Figure 7A:
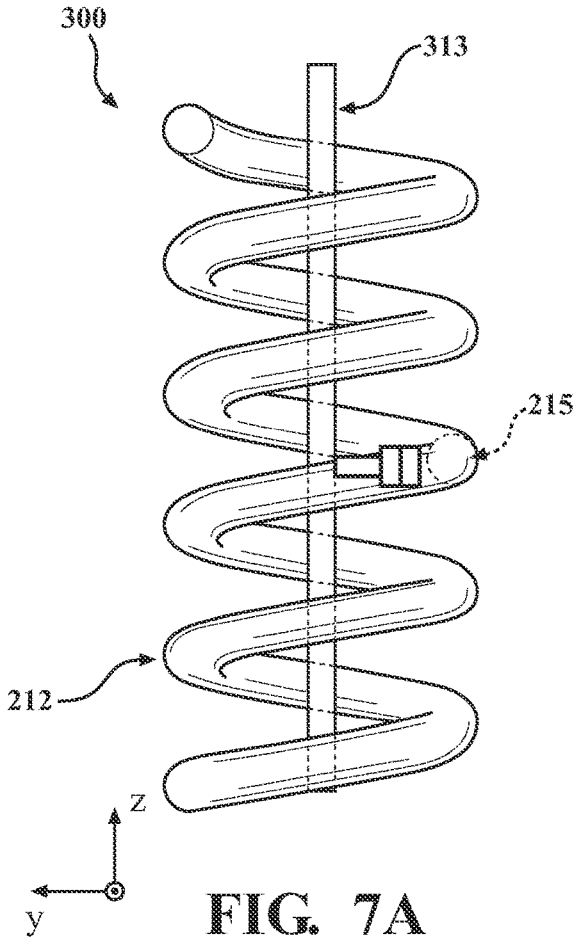
FIG. 7A is a partially transparent side plan view of a helical resonator of the type shown in FIG. 4B, having a rotating rod mechanism for moving an external magnetic element along the resonator side wall.
Figure 7B:
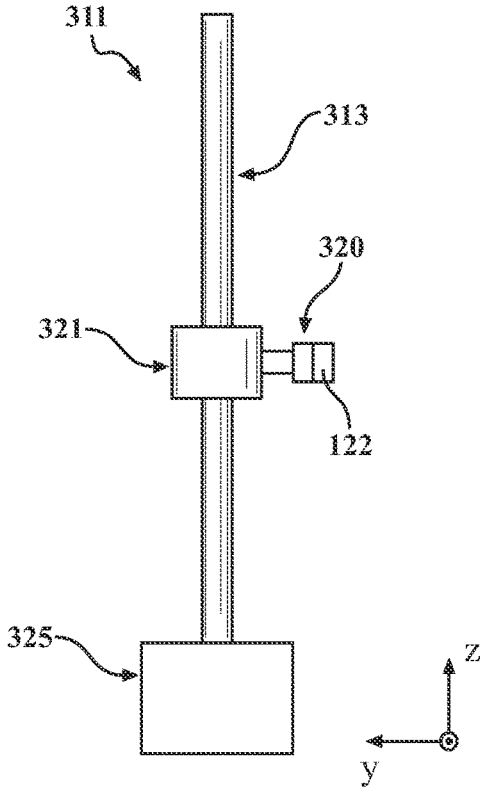
FIG. 7B is a side plan view of the rotating rod mechanism of FIG. 7A and including a motor for rotating the rod.
Figure 7C:
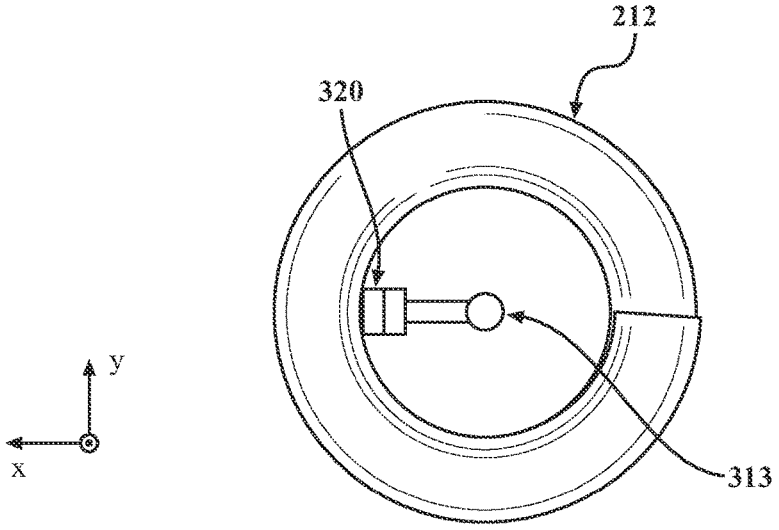
FIG. 7C is a top plan view of the resonator of FIG. 7A.

FIG. 7A, illustrating a different example, shows a partially transparent side perspective view of a helical resonator 300, along with a rotating, rod-type of mechanism for moving a spiral external magnetic element 320 along the side wall 212 of the helical resonator 200. FIG. 7B shows a side plan view of the mechanism 311 for moving the spiral external magnetic element 320, with the helical resonator 300 removed for clarity. FIG. 7C shows a top plan view of the helical resonator 300 with the spiral external magnetic element 320. The spiral external magnetic element 320 can be mounted on a rotating rod 313 positioned axially in the center of the helical resonator 300 (i.e. along the helical axis). The spiral external magnetic element 320 can be fixed laterally on the rotating rod 313, but is able to slide longitudinally on the rotating rod 313. As such, when the rod 313 rotates, the magnet 122 mounted in the spiral external magnetic element 320 can move along, and maintain contact with, the side wall 212 of the helical resonator 300. It will be understood that magnetic attraction between the sphere 213 and the spiral external magnetic element 320 both maintains contact between the external magnet 122 and the side wall 212, and impels movement of the sphere 213 inside the helical resonator 300 as the rod 313 rotates.

The rotating rod can be attached to a motor 325 configured to rotate the rod 310, for example under the direction of a controller (not shown). In some variations, the spiral external magnetic element 320 can have a protrusion that mates with a longitudinal slot in the rotating rod, thereby making the spiral external magnetic element 320 laterally fixed (i.e. in the x-y plane of FIGS. 7A-7C) relative to the rotating rod 313, but allowing the spiral external magnetic element 320 to slide longitudinally (i.e. in the z-dimension of FIGS. 7A-7C) along the rotating rod 313, as described above. Such an arrangement can allow the spiral external magnetic element 320 to trace a helical or spiral path, mirroring the helical traverse of the helical resonator 300. In an alternate variation, the rotating rod 313 can be threaded with a pitch identical to the helical pitch of the helical resonator 300. In such an alternative, the spiral external magnetic element 320 can be fixed to the rotating rod 313, and the rotating rod 313 can be rotationally raised or lowered via said threading by the motor 325. In another implementation of this variation, the attachment base 321 of the spiral external magnetic element can be equipped with a motor to move the spiral external magnetic element helically along the rod 313 which, in this variation, is stationary. In general, any mechanical arrangement enabling a spiral external magnetic element 320 to trace a helical path mirroring the helical traverse of a helical resonator 300 can be suitable.

Figure 8:
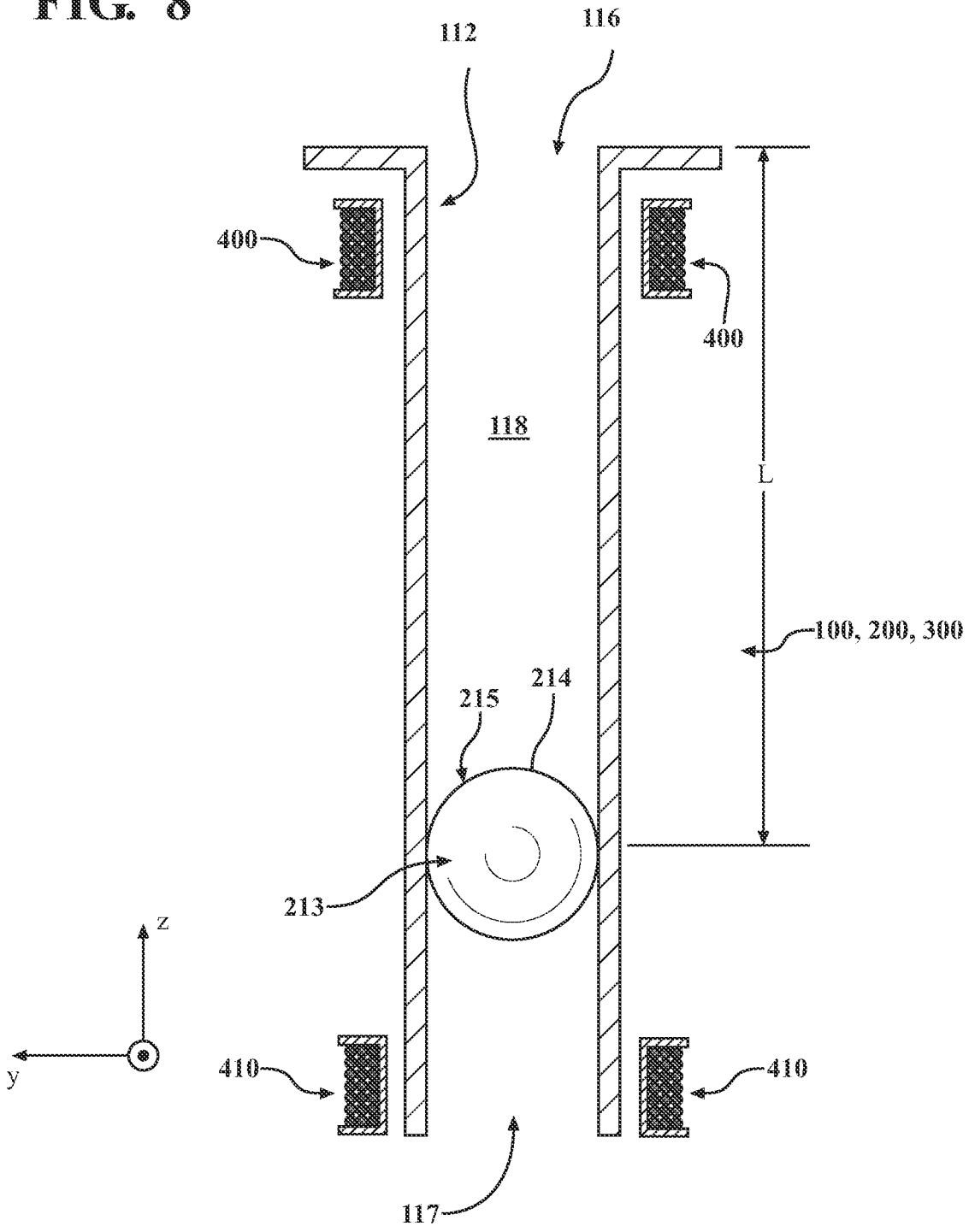
FIG. 8 is a cross-sectional view of a linear acoustic tuber resonator having a sphere defining the end wall.

In a further variation of the multiple implementations presented herein, a resonator 100, 200, 300 of the present teachings can include a sphere 213 having a sphere surface portion 214 defining an end wall 215. FIG. 8 shows a cross-sectional view of such a resonator 100, having a linear shape. The exemplary resonator 100 of FIG. 8 can have one or more open end electromagnets 400 positioned proximate to the open end 116 of the resonator 100, 200, 300. The resonator 100 can also have one or more distal end electromagnets 410 positioned proximate to the distal end 117 of the resonator 100. A power modulator (not shown) can modulate power to the one or more open end electromagnets 400 and, separately but in concert, modulate power to the one or more distal end electromagnets 410, to create a variable magnetic field across the resonator 100. Via such power modulation, and consequent alteration of the variable magnetic field, the sphere 213 can be impelled toward the open end 116 or the distal end 117 as desired. It will be appreciated that this approach can be employed with the exemplary resonators 200, 300 of FIGS. 4A and 4B, or with any variationally shaped resonator, so long as the resonator does not include any "switchbacks" (i.e. so long as traversal of the sphere 213 in one direction along the curvilinear axis, X, always moves the sphere 213 nearer the open end 116, and, correspondingly, traversal of the sphere 213 in an opposite, second direction along the curvilinear axis, X, always moves the sphere 213 nearer the distal end).

In various implementations described herein, in which an adjustable frequency quarter-wavelength resonator 100, 200, 300 employs an end wall 115, 215 that is positioned and moved via magnetic attraction, the end wall can vibrate to some extent when contacted by an incident acoustic wave. It will be understood that such vibration will generally be inversely proportional to the mass of the end wall 115 structure, or of the sphere 213 that defines the end wall. It will further be understood that such end wall 115, 215 vibration can yield an extent of additional sound absorption tending to increase the absorptive bandwidth of the resonator 100, 200, 300. In such a scenario, the adjustable frequency resonator 100, 200, 300 can be considered to contain an additional spring-mass resonator, where the mass is that of the structure on which the end wall is defined (e.g. sphere 213), and the spring is the magnetic force between the structure (e.g. sphere 213) and the external magnetic element(s) 120, 220. Bandwidth will tend to be increased because spring-mass resonator will have a resonance frequency that generally differs from that of the quarter-wavelength tube.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A variable-frequency, curved tube acoustic resonator comprising:

a side wall forming a tube defining a cylindrical resonance chamber and having an open end configured to receive an incident acoustic wave, and a distal end opposite the open end, the tube defining a curvilinear axis extending along the middle of the resonance chamber from the open end to the distal end, the curvilinear axis having at least one curved region;

a sphere comprising a ferromagnetic material positioned within the tube, defining an end wall, the sphere movable along the curvilinear axis to vary a resonance frequency of the resonator; and an external magnetic element configured to move and impel a corresponding movement of the sphere.

2. The variable-frequency, curved tube acoustic resonator as recited in claim 1, wherein the sphere has a diameter, D, that is within a range of from about 0.95 times to about 1.0 times an internal diameter, d, of the tube.

3. The variable-frequency, curved tube acoustic resonator as recited in claim 1, wherein the curved region comprises a planar curved region.

4. The variable-frequency, curved tube acoustic resonator as recited in claim 1, wherein the curved region comprises a three-dimensional curved region.

5. The variable-frequency, curved tube acoustic resonator as recited in claim 4, wherein the three-dimensional curved region is continuous along the entire length of the tube.

6. The variable-frequency, curved tube acoustic resonator as recited in claim 1, comprising at least two curved regions.

7. The variable-frequency, curved tube acoustic resonator as recited in claim 1, wherein the external magnetic element is configured to move in parallel with the curvilinear axis while positioned externally adjacent to the side wall so that movement of the external magnetic element impels the corresponding movement of the sphere along the curvilinear axis, thereby inducing a change in an effective length of the resonator.

8. The variable-frequency, curved tube acoustic resonator as recited in claim 7, wherein the external magnetic element comprises a housing component configured to slide longitudinally along an exterior surface of the side wall.

9. The variable-frequency, curved tube acoustic resonator as recited in claim 7, wherein the external magnetic element comprises:

two bearing members configured to rotate and to bear the magnet longitudinally along an exterior surface of the side wall; and an actuator configured to assist rotation of the two bearing members.

10. The variable-frequency, curved tube acoustic resonator as recited in claim 1, wherein the sphere comprises a ferromagnetic material, and the resonator comprises:

a first electromagnet positioned adjacent to the open end; and a second electromagnet positioned adjacent to the distal end, wherein power modulation to the first and second electromagnets to the first and second electromagnets enables a variable magnetic field to impel the sphere along the curvilinear axis.

11. A variable-frequency, tube acoustic resonator comprising:

a side wall forming a tube defining a cylindrical resonance chamber and having an open end configured to receive an incident acoustic wave, and a distal end opposite the open end;

a sphere, defining an end wall, the sphere comprising a ferromagnetic material, and positioned within the tube, movable along a longitudinal tube axis to vary a resonance frequency of the resonator;

a first electromagnet positioned adjacent to the open end; and a second electromagnet positioned adjacent to the distal end, wherein power modulation to the first and second electromagnets enables a variable magnetic field to impel the sphere along the longitudinal axis.

12. The variable-frequency, tube acoustic resonator as recited in claim 11, wherein the sphere comprises a ferromagnetic core contactingly surrounded by a non-magnetic shell.

13. The variable-frequency, tube acoustic resonator as recited in claim 12, wherein the ferromagnetic core and the non-magnetic shell are rotationally independent of one another.

14. A variable-frequency, curved tube acoustic resonator comprising:

a side wall forming a tube defining a cylindrical resonance chamber and having an open end configured to receive an incident acoustic wave, and a distal end opposite the open end, the tube defining a curvilinear axis extending along the middle of the resonance chamber from the open end to the distal end, the curvilinear axis having a helical shape; and a sphere positioned within the tube, defining an end wall, the sphere movable along the curvilinear axis to vary a resonance frequency of the resonator.

15. The variable frequency, curved tube acoustic resonator as recited in claim 14, wherein the sphere has a diameter, D, that is within a range of from about 0.95 times to about 1.0 times an internal diameter, d, of the tube.

16. The variable frequency, curved tube acoustic resonator as recited in claim 14, wherein the side wall is coated with a lubricating layer.

17. The variable frequency, curved tube acoustic resonator as recited in claim 14, wherein the sphere comprises a ferromagnetic material, and the resonator comprises:

an external magnetic element comprising a magnet, and is configured to move in parallel with the curvilinear axis while positioned externally adjacent to the side wall so that movement of the external magnetic element impels a corresponding movement of the sphere along the curvilinear axis, thereby inducing a change in an effective length of the resonator.

18. The variable frequency, curved tube acoustic resonator as recited in claim 17, wherein the external magnetic element is mounted on a rod positioned along a helical axis of the curvilinear axis, and is configured to move the external magnetic element in a helical path.

19. The variable frequency, curved tube acoustic resonator as recited in claim 18, wherein the external magnetic element is fixed laterally and longitudinally mobile relative to the rod, and the rod is mounted on a motor configured to rotate the rod, such that rotation of the rod, in combination with magnetic attraction between the sphere and the external magnetic element both maintains contact between the magnet and the side wall, and impels movement of the sphere along the curvilinear axis.

20. The variable frequency, curved tube acoustic resonator as recited in claim 14, wherein the sphere comprises a ferromagnetic material, and the resonator comprises:

a first electromagnet positioned adjacent to the open end; and a second electromagnet positioned adjacent to the distal end, wherein power modulation to the first and second electromagnets to the first and second electromagnets enables a variable magnetic field to impel the sphere along the curvilinear axis.

* * * * *